US008408671B2

(12) United States Patent
Doo

(10) Patent No.: US 8,408,671 B2
(45) Date of Patent: Apr. 2, 2013

(54) INK JET RECORDING APPARATUS EQUIPPED WITH ULTRAVIOLET LIGHT IRRADIATION DEVICE

(75) Inventor: Harumichi Doo, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 402 days.

(21) Appl. No.: 12/512,920

(22) Filed: Jul. 30, 2009

(65) Prior Publication Data

US 2011/0025746 A1 Feb. 3, 2011

(51) Int. Cl.
*B41J 29/38* (2006.01)

(52) U.S. Cl. ..... 347/16

(58) Field of Classification Search ..... 347/16, 347/101, 104–105
See application file for complete search history.

(56) References Cited

U.S. PATENT DOCUMENTS

| | | | | |
|---|---|---|---|---|
| 6,065,831 | A * | 5/2000 | Kawaura et al. | 347/108 |
| 6,219,508 | B1 * | 4/2001 | Nagatomi et al. | 399/125 |
| 7,222,953 | B2 * | 5/2007 | Yokoyama | 347/102 |
| 7,887,179 | B2 * | 2/2011 | Toyoshima | 347/104 |
| 2006/0023024 | A1 * | 2/2006 | Niekawa | 347/37 |
| 2009/0278873 | A1 * | 11/2009 | Motoyama et al. | 347/9 |

* cited by examiner

*Primary Examiner* — Jason Uhlenhake
(74) *Attorney, Agent, or Firm* — Lee, Hong, Degerman, Kang & Waimey

(57) ABSTRACT

An ink jet recording apparatus is presented. The ink jet recording apparatus includes a supporting member for supporting a recording medium, a roller disposed at the rear of and below the supporting member, wherein the recording medium is wound on the roller, a first transfer mechanism for transferring the recording medium wound on the roller toward the supporting member, a guide rail, an ink head that engages with the guide rail, an ultraviolet light irradiation device that is coupled to the ink head, and a cover that has at least a portion located above the roller and suppresses emission of ultraviolet light.

7 Claims, 10 Drawing Sheets

INK JET RECORDING APPARATUS EQUIPPED WITH ULTRAVIOLET LIGHT IRRADIATION DEVICE

BACKGROUND OF THE INVENTION

1. Field of the Invention

The present invention relates to an ink jet recording apparatus equipped with an ultraviolet light irradiation device.

2. Discussion of the Related Art

Ink jet recording apparatuses that use ultraviolet light curable ink, are conventionally known in the art, for example, U.S. Pat. No. 7,232,212. The ink jet recording apparatuses may be equipped with a device for irradiating ultraviolet light to cure the ink discharged from the ink head on a recording medium.

The recording medium utilized in an ink jet recording apparatus is consumed during a print operation, therefore, the recording medium needs to be periodically refilled. Additionally, the internal mechanisms of the ink jet recording apparatus need to be periodically inspected in order to properly maintain the internal mechanisms of the ink jet recording apparatus. Thus, operators of the ink jet recording apparatus must pay close attention so as not to be exposed to ultraviolet light irradiated from the ultraviolet light irradiation device. Accordingly, for the reasons presented above, conventional ink jet recording apparatuses equipped with an ultraviolet light irradiation device are difficult to maintain.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

According to one embodiment, an ink jet recording apparatus is presented. The ink jet recording apparatus includes a supporting member for supporting a recording medium, a roller disposed at the rear of and below the supporting member, wherein the recording medium is wound on the roller, a first transfer mechanism for transferring the recording medium wound on the roller toward the supporting member, a guide rail that extends in a left-right direction, an ink head that engages with the guide rail in a freely moveable manner in the left-right direction along the guide rail, and disposed opposite to the supporting member during a print operation for ejecting ultraviolet light curable ink on the recording medium, a second transfer mechanism for transferring the ink head in the left-right direction, an ultraviolet light irradiation device that is coupled to the ink head in a freely moveable manner to be moveable with the ink head in the left-right direction, and disposed opposite the recording medium during a print operation for irradiating ultraviolet light onto the ultraviolet light curable ink discharged on the recording medium, and a cover that has at least a portion located above the roller and suppresses emission of ultraviolet light.

According to one feature, an upper end of the cover is positioned above an irradiation position on the recording medium irradiated by the ultraviolet light irradiation device. Additionally, a lower end of the cover is positioned above an upper end of the roller, and a rear end of the cover is positioned at the rear of a rear end of the roller. Furthermore, the cover has a sloped segment that slopes diagonally downwardly towards the rear.

According to another feature, the ink jet recording apparatus further includes a case for storing at least one of the supporting member, the ink head, and the ultraviolet light irradiation device, and comprising an opening that opens at least frontward or upward, a front cover that is attached to the case to cover at least a part of the opening in a manner to be freely opened and closed, and suppresses emission of ultraviolet light, a detector for detecting the open or closed states of the front cover, an irradiation control device for controlling irradiation of ultraviolet light by the ultraviolet light irradiation device, and a stop control device for stopping irradiation of ultraviolet light by the ultraviolet light irradiation device, when the detector detects that the front cover is opened while the irradiation control device is controlling the ultraviolet light irradiation device.

According to another embodiment, an ink jet recording apparatus is presented. The ink jet recording apparatus includes a supporting member for supporting a recording medium, a guide rail extending in a left-right direction, a first transfer mechanism for transferring the recording medium on the supporting member in a front-rear direction, an ink head that engages with the guide rail in a freely moveable manner in the left-right direction along the guide rail, and disposed opposite to the recording medium during a print operation for ejecting ultraviolet light curable ink on the recording medium, a second transfer mechanism for transferring the ink head in the left-right direction, an ultraviolet light irradiation device that is coupled to the ink head in a freely moveable manner to be moveable with the ink head in the left-right direction, and disposed opposite the recording medium during a print operation for irradiating ultraviolet light onto the ultraviolet light curable ink discharged on the recording medium, a case that stores at least one of the supporting member, the ink head, and the ultraviolet light irradiation device, and that comprises an opening that opens at least frontward or upward, a front cover that is attached to the case to cover at least a part of the opening in a manner to be freely opened and closed, and suppresses emission of ultraviolet light, a detector for detecting the open/close states of the front cover, an irradiation control device for controlling irradiation of ultraviolet light by the ultraviolet light irradiation device, and a stop control device for preventing irradiation of ultraviolet light by the ultraviolet light irradiation device, when the detector detects that the front cover is opened while the irradiation control device is controlling the ultraviolet light irradiation device.

These and other embodiments will also become readily apparent to those skilled in the art from the following detailed description of the embodiments having reference to the attached figures, the invention not being limited to any particular embodiment disclosed.

DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
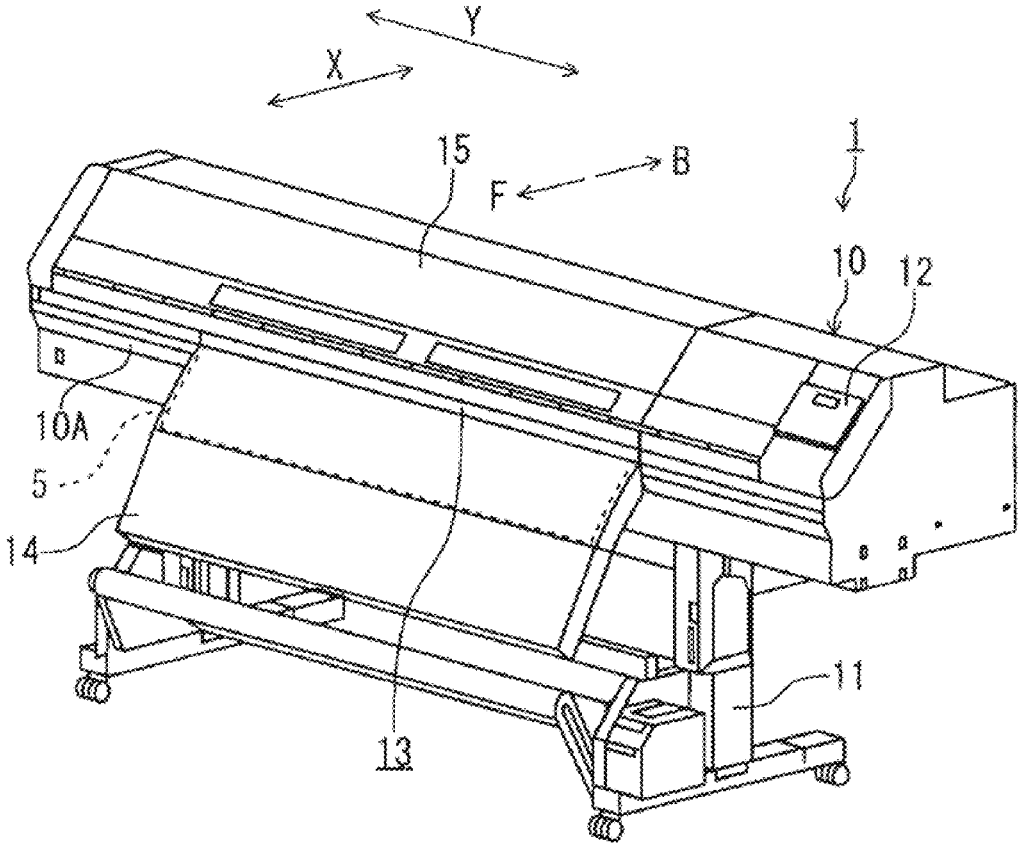
FIG. 1 is a perspective view of an ink jet printer according to an embodiment of the present invention.

FIG. 1 illustrates an ink jet recording apparatus in accordance with an embodiment of the invention may be an ink jet printer 1. However, the ink jet recording apparatus in accordance with the present embodiment is not limited to the ink jet printer 1 and may comprise alternate embodiments.

Figure 3:
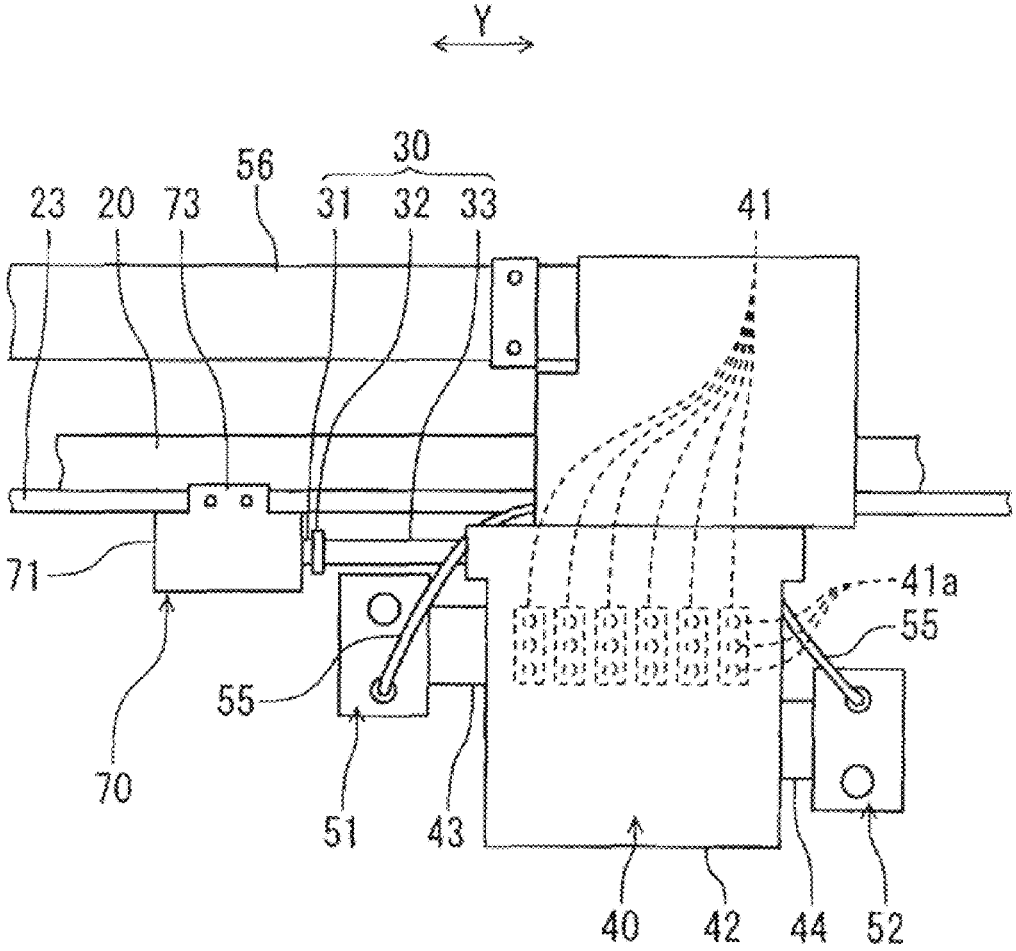
FIG. 3 is a plan view of a cutting head, an ink head and an ultraviolet light irradiation device according to an embodiment of the present invention.
Figure 4:
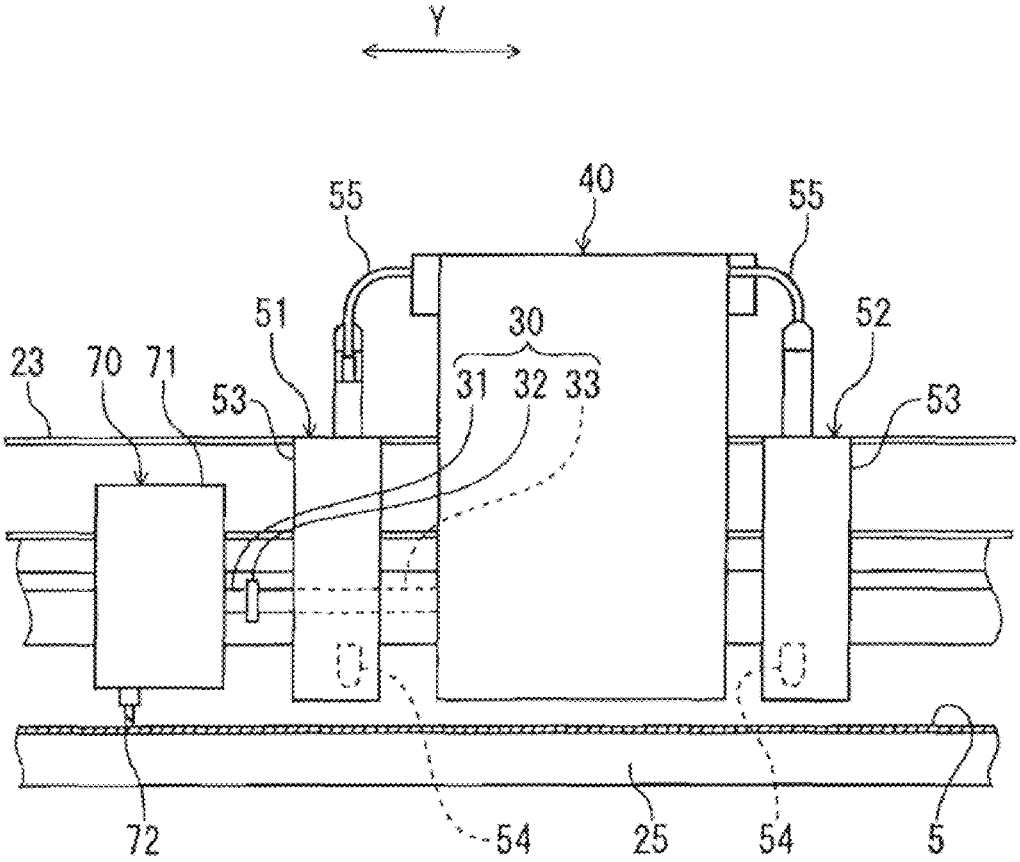
FIG. 4 is a front view of the cutting head, the ink head and the ultraviolet light irradiation illustrated in FIG. 3.

The ink jet printer 1 is equipped with an ink head 40 and a cutting head 70 (see FIG. 3 and FIG. 4). The ink jet printer 1 is capable of performing printing and cutting operations with respect to a sheet of recording paper 5.

It is noted that a symbol Y shown in FIG. 1 refers a first scanning direction, and a symbol X refers to a second scanning direction that is a direction perpendicular to the first scanning direction. The first scanning direction refers to a direction for the movement of the ink head 40 and the cutting head 70, and the second scanning direction refers for a direction for the movement of the recording paper 5.

The ink jet printer 1 is provided with a main body 10 having a casing 10A that extends in the first scanning direction, and legs 11 that support the main body 10. An operation panel 12 is provided on the side of the main body 10.

Although not illustrated, the operation panel 12 may be equipped with various components, for example, but not limited to, a display section that displays various operation states, a cursor key for designating the positions of the ink head 40 and the cutting head 70, a region setting key for designating a region of a specified portion for which printing or cutting based on an image data signal, an operation start key for starting printing or cutting from the designated print or cut region.

A front cover 15, which may be freely opened and closed, is mounted on an upper portion of the main body 10. A discharge port 13 for discharging the recording paper 5 is formed on the lower side of the main body 10. A guide 14 is provided the front of the main body and below the discharge port 13. The guide 14 guides the recording paper 5 discharged from the discharge port 13 in a forwardly diagonal downward direction.

It is noted that, in the current embodiment, the left-right direction refers to the first scanning direction, and the front-rear direction refers to the second scanning direction. Additionally, the front-rear, left-right, and up-down directions correspond to directions as seen from a position of an operator (not shown) facing the front of the discharge port 13, respectively. It is noted, however, that the front-rear, left-right and up-down directions as seen from a position of an operator are relative, and change depending on the positional relation between the operator and the ink jet printer 1. For this reason, as stated above, the left-right direction refers to the first scanning direction and the front-rear direction refers to the second scanning direction. It is noted that, in the figures, such as, in FIG. 1, a symbol F refers the front and a symbol B refers the back.

Figure 2:
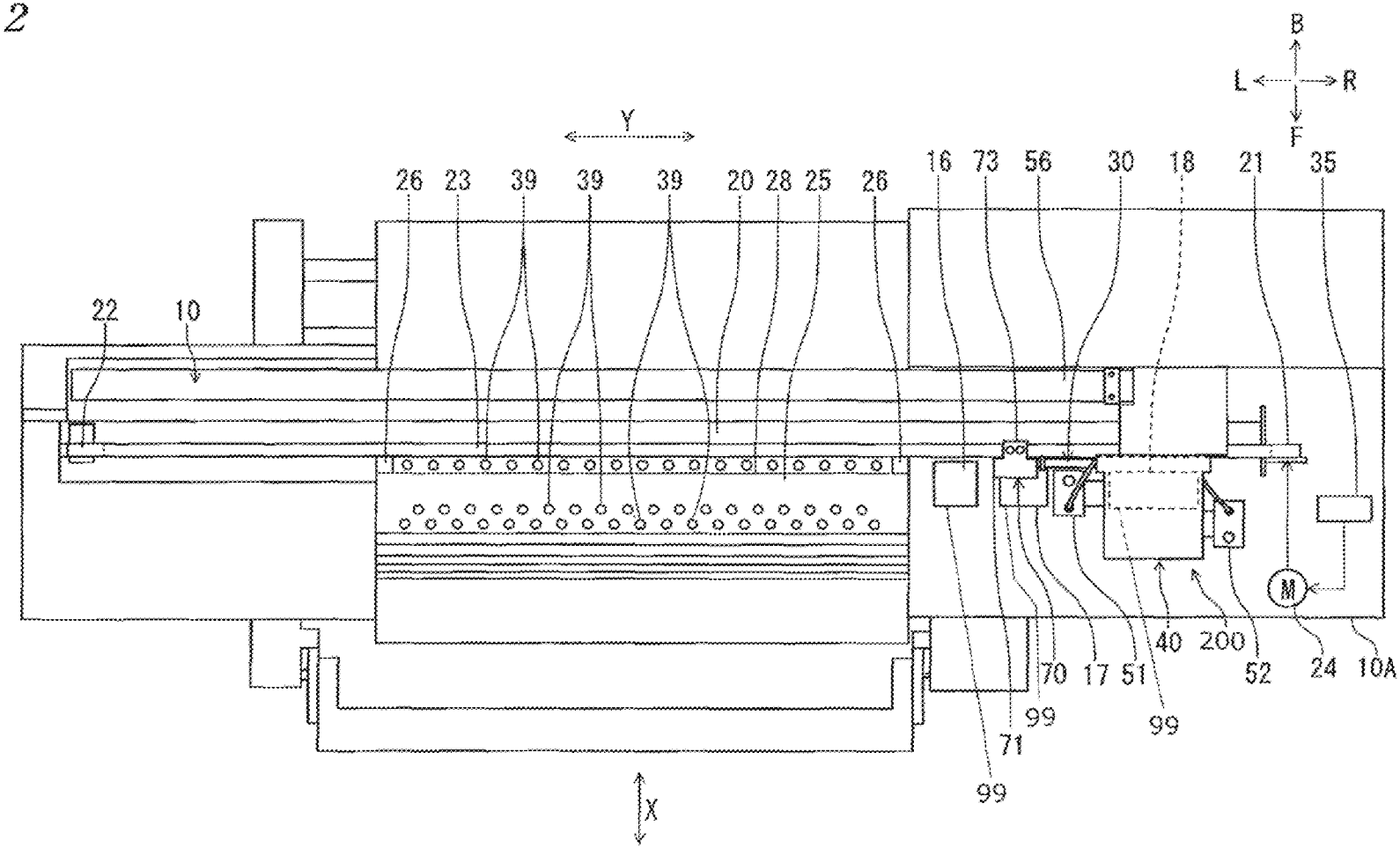
FIG. 2 is a plan view showing the internal structure of the ink jet printer illustrated in FIG. 1.

The internal structure of the main body 10 shall be described with respect to FIG. 2. As shown in FIG. 2, a guide rail 20 extending in the left-right direction is provided inside the main body 10. A platen 25 is disposed in a central area and in front of the guide rail 20.

The platen 25 supports the recording paper 5 when the ink head 40 is printing and when the cutting head 70 is cutting. Specifically, printing and cutting of the recording paper 5 are conducted on the platen 25.

A first pulley 21 is provided adjacent to the right end section of the guide rail 20, and a second pulley 22 is provided adjacent to the left end section of the guide rail 20. A belt 23 is wound around the first pulley 21 and the second pulley 22.

A motor 24 is coupled to the first pulley 21. The belt 23 is driven between the first pulley 21 and the second pulley 22 when the motor 24 drives the first pulley 21. A control device 35 is connected to the motor 24. The motor 24 is a motor that can be freely rotated in forward and reverse directions. The control device 35 controls the motor 24, thereby controlling movements of a carriage 73. It is noted that, in accordance with the present embodiment, the motor 24 drives the first pulley 21, still, the motor 24 may drive the second pulley 22.

As shown in FIG. 2, a pair of upper and lower rollers 26 are provided at the left end section and the right end section of the platen 25 for feeding the recording paper 5 in the second scanning direction X (it is noted that FIG. 2 only illustrates the upper rollers 26). Among the pair of upper and lower rollers 26, one of the rollers is a driving roller that rotates itself, and the other roller is a pinching roller for pinching the recording paper 5 with the driving roller.

The operation of the driving rollers is controlled by the control device 35. The rollers 26 form a transfer mechanism that transfers the recording paper 5 in the second scanning direction. Additionally, in accordance with another embodiment, the set positions of the pair of upper and lower rollers 26 may not be limited to the left end section and the right end section of the platen 25.

The cutting head 70 will be described with respect to FIGS. 3 and 4. As shown in FIG. 4, the cutting head 70 is equipped with a cutter 72, a holder 71 that retains the cutter 72, and a carriage 73 (see FIG. 3) provided on the holder 71. The holder 71 engages with the guide rail 20, and is guided by the guide rail 20 along the first scanning direction.

As shown in FIG. 3, the carriage 73 is affixed to the belt 23. The carriage 73 is transferred in the left and right directions as the belt 23 is driven. The carriage 73 moves to the left as the motor 24 rotates in one direction and the carriage 73 moves to the right as the motor 24 rotates a second direction. In accordance with the present embodiment, the carriage 73 is built in the cutting head 70. However, the carriage 73 may be formed as one piece with the holder 71, or may be formed independently.

It should be noted, however, that the carriage 73 is not limited to the carriage 73 that is built in the cutting head 70. The carriage 73 may be provided independently of the cutting head 70. More specifically, the carriage 73 may be coupled to the cutting head 70 in a manner such that the carriage 73 may be attachable to the cutting head 70. Furthermore, the carriage 73 may be built in the ink head 40. Alternatively, the carriage 73 may be provided independently of both of the cutting head 70 and the ink head 40.

The cutting head 70 is a head for cutting the recording paper 5. During a cut operation, the cutter 72 is lowered and pushed against the recording paper 5. Then, the cutting head 70 moves in the first scanning direction in response to a movement of the carriage 73. Additionally, the recording paper 5 is transferred by the rollers 26 in the second scanning direction. Thus, an arbitrary portion of the recording paper 5 can be cut out as a result or the movement of the cutter 72 and the recording paper 5.

It is noted that the cutting operation on the recording paper 5 by the cutter 72 not only includes cutting the entire recording paper 5, but also includes cutting a portion of the recording paper 5. In other words, cutting the recording paper 5 by the cutter 72 is not limited to cutting by completely penetrating the cutting paper 5 by the cutter 72.

For example, the recording paper 5 may comprise a plurality of layers, and the cutter 72 is moved with respect to the recording paper 5 and may only penetrates only an upper portion of the layers of the recording paper 5. Accordingly, the cutter 72 only cuts a portion of the recording paper 5.

The ink head 40 shall be described with respect to FIG. 3. The ink head 40 ejects ink toward the recording paper 5. As indicated in FIG. 3, an ink head 40 has a plurality of print heads 41 for ejecting ink droplets, each print head having a plurality of nozzles 41*a* for ejecting ink. The ink head 40 also comprises a print head carriage 42 that supports the plurality of print heads 41. The ink head 40 ejects ink toward the recording paper 5.

FIG. 3 shows an enlarged view of the nozzles 41*a*, and for the sake of convenience also shows a limited number of nozzles 41*a*. According to current embodiment, the size of the nozzles 41*a* is much smaller than that illustrated in FIG. 3, and the nozzles 41*a* are formed in a greater number in the print head 41.

The print head carriage 42 engages with the guide rail 20 such that the print head carriage 42 is freely moveable in the left-right direction. The print heads 41 eject ink droplets downward from the nozzles. Ink cartridges filled with ink are mounted at the rear of the main body 10 (not shown). The print heads 41 are connected to the ink cartridges via tubes (not shown) disposed within a cableveyor 56. Ink is supplied to the print heads 41 from the ink cartridges described above. The control device 35 controls the ejection of ink via the ink head 40.

The ink head 40 ejects ultraviolet light curable ink. More specifically, at least one of the print heads 41 ejects ultraviolet light curable ink. The ink jet printer 1 is equipped with a first ultraviolet light irradiation device 51 and a second ultraviolet light irradiation device 52. The first ultraviolet light irradiation device 51 is mounted to the left side of the print head carriage 42 via a connection member 43. The first ultraviolet light irradiation device 51 is located between the ink head 40 and the cutting head 70. The second ultraviolet light irradiation device 52 is mounted to the right side of the print head carriage 42 via a connection member 44. The first ultraviolet light irradiation device 51 and the second ultraviolet light irradiation device 52 are disposed with their centers located in the front-rear direction. The first ultraviolet light irradiation device 51 is disposed in a more rear position in comparison to the second ultraviolet light irradiation device 52. The control device 35 controls the irradiation operations of both of the ultraviolet light irradiation devices 51 and 52.

As shown in FIG. 4, the first ultraviolet light irradiation device 51 is equipped with a case 53, a light source 54 provided within the case 53, and a cable 55 for supplying electricity to the light source 54. The light source 54 is formed from an ultraviolet light emitting diode. The cable 55 is connected to a power supply (not illustrated) via the cableveyor 56 (see FIG. 2). The structure of the second ultraviolet light irradiation device 52 is similar to the structure of the first ultraviolet light irradiation device 51.

It is noted that the ultraviolet light irradiation devices 51 and 52 are not limited to ultraviolet light emitting diodes. Other irradiation devices, such as, halogen lamps, may also be utilized in the ultraviolet light irradiation devices 51 and 52.

As shown in FIG. 3, a coupling mechanism 30 is provided at the rear of the first ultraviolet light irradiation device 51 for detachably coupling the cutting head 70 and the ink head 40. The coupling mechanism 30 is equipped with a coupling member 31 extending from the holder 71 to the right, a magnet 32 provided at the right end of the coupling member 31, and a coupling member 33 extending from the rear left side of the print head carriage 42 to the left. The left end section of the coupling member 33 is formed from a magnetic material, such as iron.

As the magnet 32 comes in contact with the coupling member 33, the coupling member 33 is attracted by the magnet 32. As a result, the cutting head 70 and the ink head 40 are coupled to each other via the coupling mechanism 30.

The cutting head 70 moves in the first scanning direction according to movements of the belt 23. Therefore, as the cutting head 70 and the ink head 40 are coupled to each other, the ink head 40 moves in the first scanning direction together with the cutting head 70. At the time of printing, the cutting head 70 and the ink head 40 are coupled to each other via the coupling mechanism 30, and the ink head 40 is transferred in the first scanning direction by the carriage 73.

In the present embodiment, the coupling mechanism 30 is equipped with the magnet 32, and uses the magnetic force. However, the coupling mechanism 30 is not limited to the one equipped with the magnet 32, and may be sufficient as long as it can detachably couple the cutting head 70 and the ink head 40.

As shown in FIG. 2, the ink head 40 is positioned adjacent to the right end section of the guide rail 20 when the printing operation is not performed, specifically, the ink head 40 is positioned at a home position 200. The ink head 40 and the casing 10A are provided with a lock mechanism (not shown) for locking the ink head 40 at the home position 200.

The connection between the cutting head 70 and the ink head 40 is released when the cutting head 70 moves to the left and when the ink head 40 is locked by the lock mechanism. Specifically, when the carriage 73 moves the cutting head 70 to the left as described above, the magnet 32 of the coupling mechanism 30 is separated from the coupling member 33. As a result, the ink head 40 remains at the home position 200, and the cutting head 70 moves in the first scanning direction. During a cut operation, the connection between the cutting head 70 and the ink head 40 is released, and the carriage 73 transfers the cutting head 70 in the first scanning direction.

As shown in FIG. 2, a cap 18 for covering the nozzles 41*a* of the ink head 40 when the ink head 40 is located at the home position 200 is provided below the ink head 40 (FIG. 3). A wiper 17 is provided to the left of the cap 18 for wiping a surface of the ink head 40 where the nozzles 4 la are formed. Also, a container 16 is provided to the left of the wiper 17 for collecting ink ejected from the ink head 40.

In order to prevent the nozzles 41*a* of the ink head 40 from clogging, the ink jet printer 1 may discharge ink from the nozzles 41*a*, irrespective of printing operations. The container 16 is provided for collecting ink discharged in order to prevent clogging of the nozzles 41*a*. The container 16, the wiper 17, and the cap 18 form an ink head aiding system 99.

It is noted that, in accordance with the present embodiment as described above, the home position 200 for the ink head 40 is provided in the right end section of the main body 10.

However, the home position 200 for the ink head 40 is not limited to the right end section of the main body 10, but may be provided in any section of the main body 10.

Figure 5:
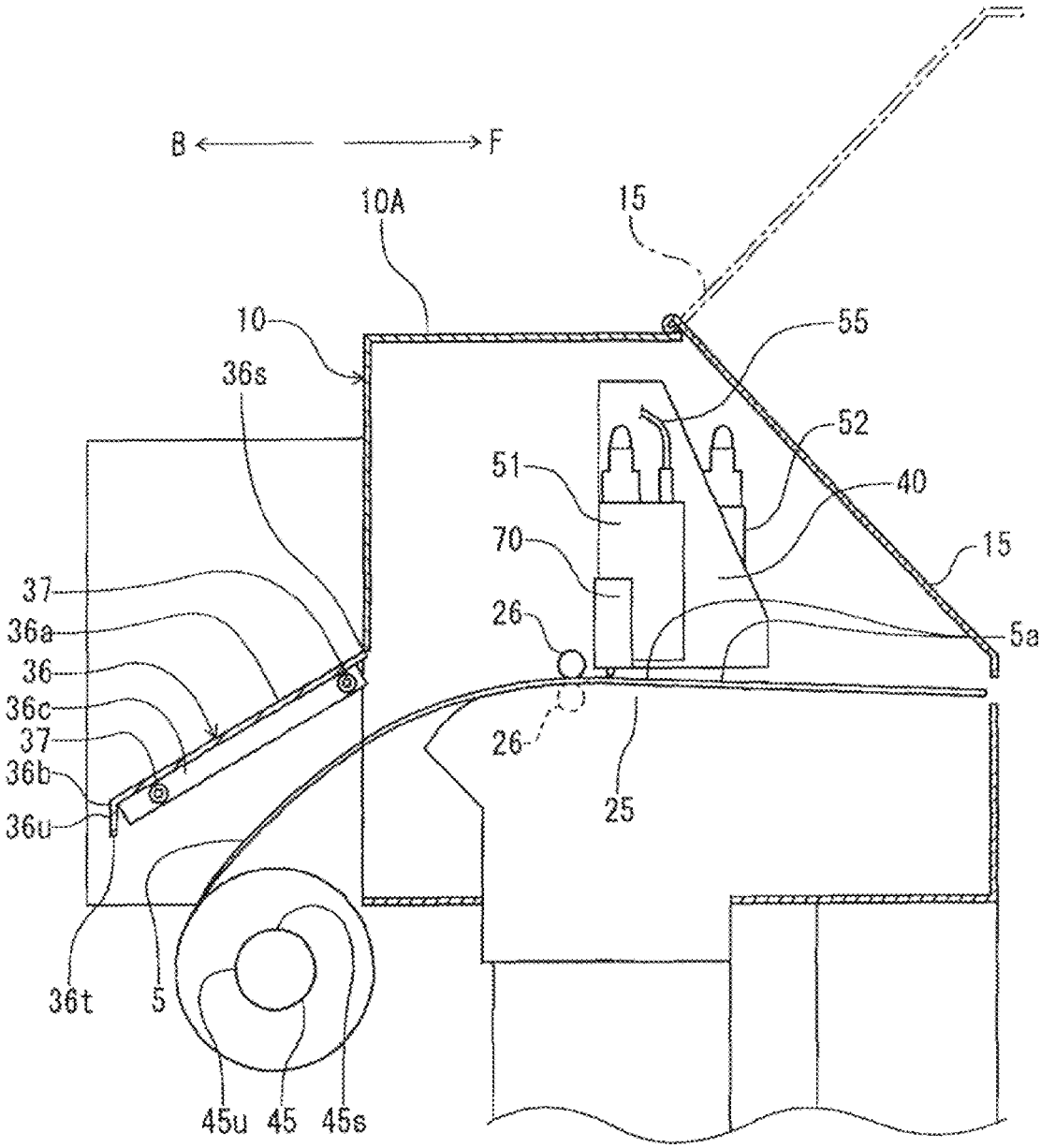
FIG. 5 is a side cross-sectional view of the internal structure of the ink jet printer illustrated in FIG. 1.

As shown in FIG. 5, a roller 45 having the recording paper 5 wound thereon is disposed at the rear of and below the platen 25. It is noted that, in FIG. 5, illustration of the guide rail 20, the belt 23 and the like is omitted for convenience.

Figure 6:
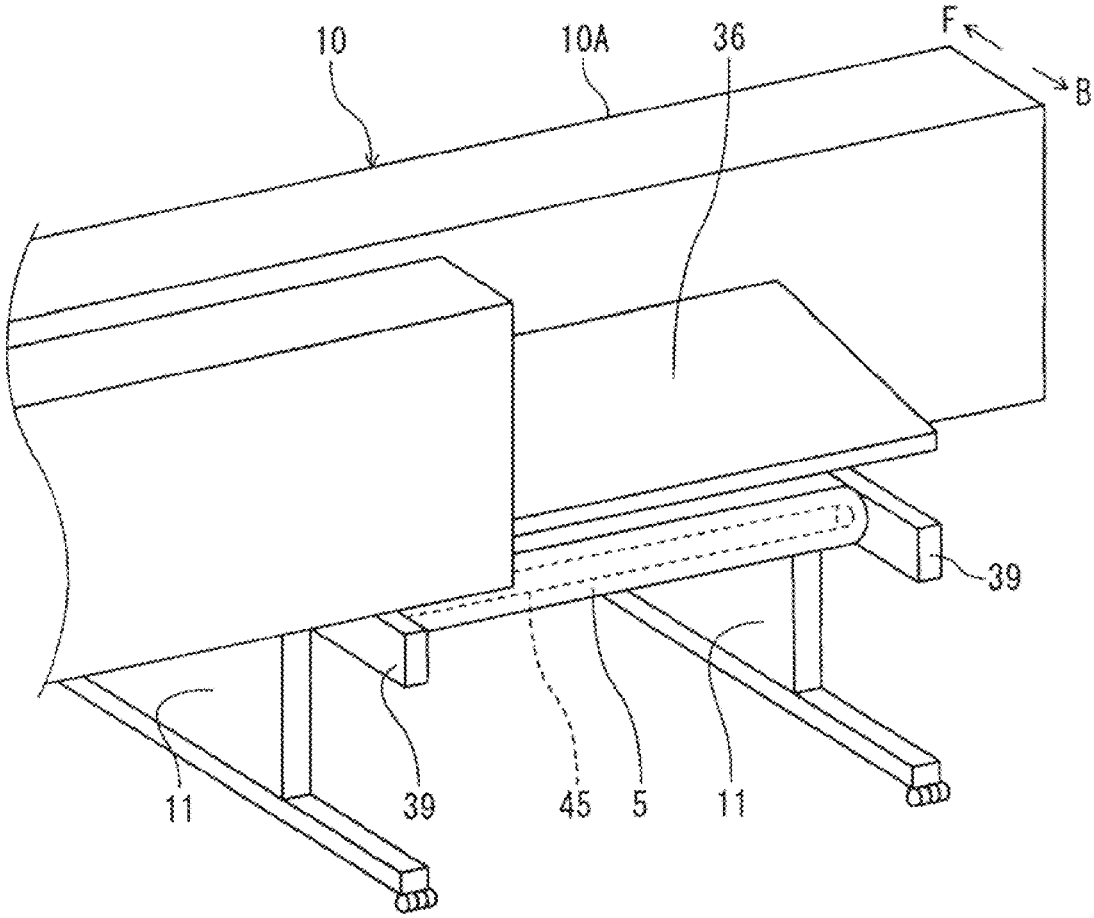
FIG. 6 is a rear perspective view of a part of the ink jet printer illustrated in FIG. 1.
Figure 7:
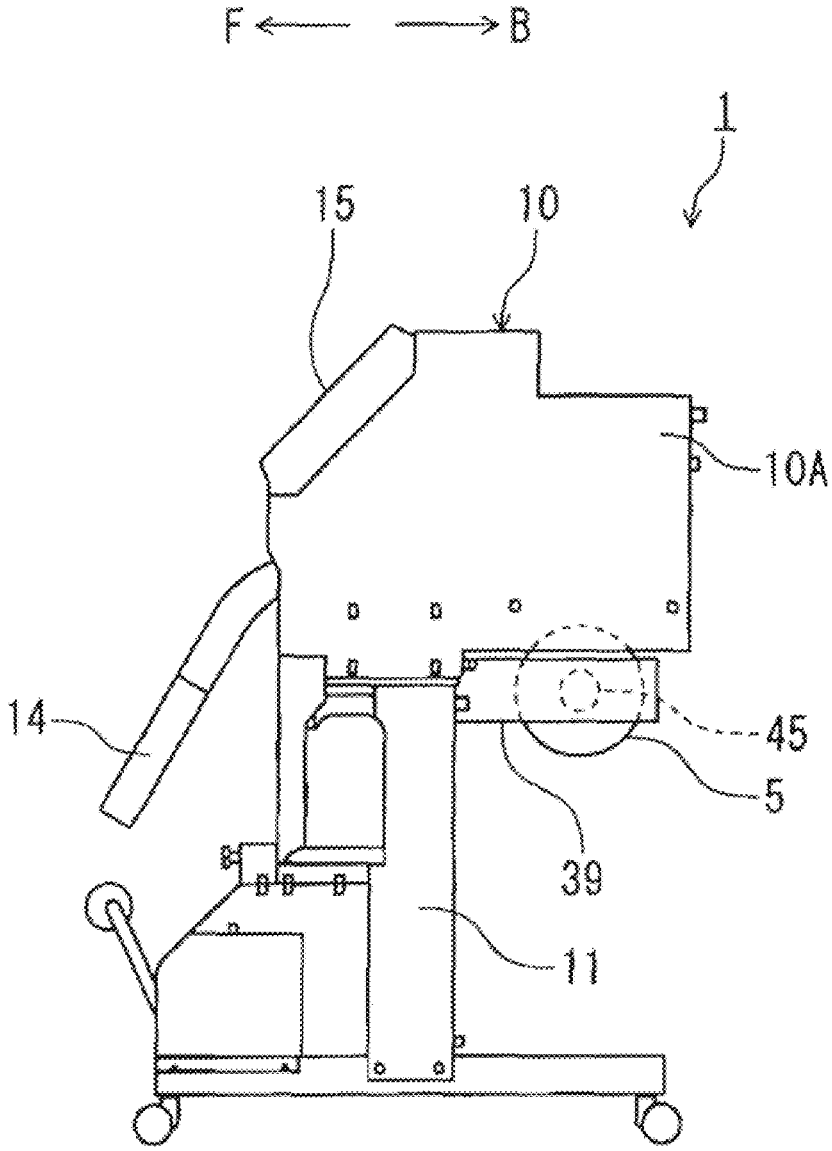
FIG. 7 is a right side view of the ink jet printer illustrated in FIG. 1.

As shown in FIG. 6, the legs 11 are provided with a pair of left and right supporting plates 39 that extend towards the rear of the main body 10. The roller 45 is supported by the supporting plates 39 and is freely rotatable. The roller 45 is an elongated thin roller extending in the left-right direction. The length of the roller 45 is generally the same as the length of the platen 25.

As shown in FIG. 5 and FIG. 6, a cover 36 is provided above the roller 45. At least a portion of the cover 36 is located above the roller 45. As shown in FIG. 6, the length, in the left-right direction, of the cover 36 is generally the same as the length, in the left-right direction, of the roller 45. However, the shape and the measurement of the cover 36 are not particularly limited.

As shown in FIG. 5, in accordance with the present embodiment, the cover 36 is equipped with a sloped segment 36*a* sloped upwardly toward the front of the main body 10, a vertical segment 36*b* that extends vertically downward from a rear end section of the sloped segment 36*a*, and vertical segments 36*c* that extend vertically downward in the left-right direction from end sections of the sloped segment 36*a*. The vertical segments 36*c* are affixed to the casing 10A by fasteners such as bolts and screws. However, the method for attaching the cover 36 is not at limited to a specific structure.

The cover 36 is provided to suppress or prevent ultraviolet light irradiated from the ultraviolet light irradiation devices 51 and 52 from emitting outside of the casing 10A. In accordance with the present embodiment, the cover 36 is formed from a material that prevents transmission of ultraviolet light, for example, metal. However, the cover 36 may be made of any material that may suppresses or prevents transmission of ultraviolet light, without any particular limitation to any material.

As shown in FIG. 5, a portion of the recording paper 5 which is located immediately below the ultraviolet light irradiation devices 51 and 52 is referred to as irradiated region 5*a* to which ultraviolet light is irradiated. As shown in FIG. 5, an upper end 36*s* of the cover 36 is positioned at location which is higher than the irradiated region 5*a*. Also, as shown in FIG. 5, a lower end 36*t* of the cover 36 is positioned at location which is above an upper end 45*s* of the roller 45. Finally, a rear end 36*u* of the cover 36 is located towards the rear of a rear end 45*u* of the roller 45

Operations of the ink jet printer 1 will be described below. The ink jet printer 1 is capable of printing on the recording paper 5 with the ink head 40, and cutting the recording paper 5 with the cutting head 70.

During a print operation, the ink head 40 ejects ink toward the recording paper 5 while reciprocally moving in the first scanning direction. The recording paper 5 is transferred by the rollers 26 in the second scanning direction.

For example, as the ink head 40 moves in the first scanning direction, the recording paper 5 is transferred forward by a predetermined length, furthermore, the direction of the ink head 40 is reversed and moves in the first scanning direction, the recording paper 5 is again transferred forward by a predetermined length. Similar operations are then repeated Additionally, the ultraviolet light irradiation devices 51 and 52 are synchronized with the movements of the ink head 40 in the first scanning direction. By this, ultraviolet light is irradiated on the ink discharged on the recording paper 5. Then, the ink on the recording paper 5 is cured, and fixed on the recording paper 5. A two-dimensional image is formed on the recording paper 5 as a result of the movement of the recording paper 5, the ink head 40, and the ultraviolet light irradiation devices 51 and 52.

The transfer direction of the recording paper 5 not limited to the forward direction. After completing printing on a predetermined region of the recording paper 5, the recording paper 5 may be moved backward, and the predetermined region may be printed again. In other words, a plurality of inks may be superposed on the recording paper 5.

During the cut operation, the ink head 40 remains at the home position 200 in a disconnected state from the cutting head 70, as described above. The cutting head 70 moves in the first scanning direction and the cutter 72 of the cutting head 70 (see FIG. 4) is lowered when the cutting head 70 moves to a predetermined position above the recording paper 5, thereby cutting the recording paper 5.

While the cutter 7 maintains the position of cutting the recording paper 5, the cutting head 70 moves in the first scanning direction, and the recording paper 5 is transferred by the rollers 26 in the second scanning direction, and thereby, the recording paper 5 is cut in a predetermined shape.

Figure 8A:
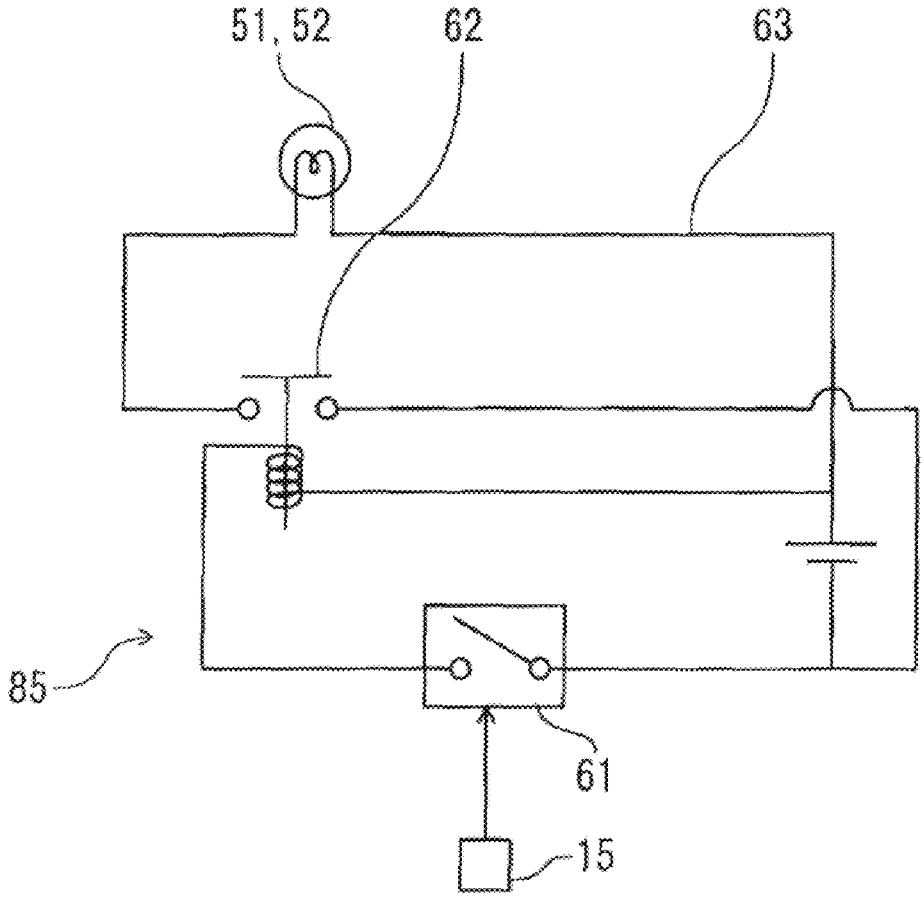
FIGS. 8A and 8B illustrate the structure of a stop control device.
Figure 8B:
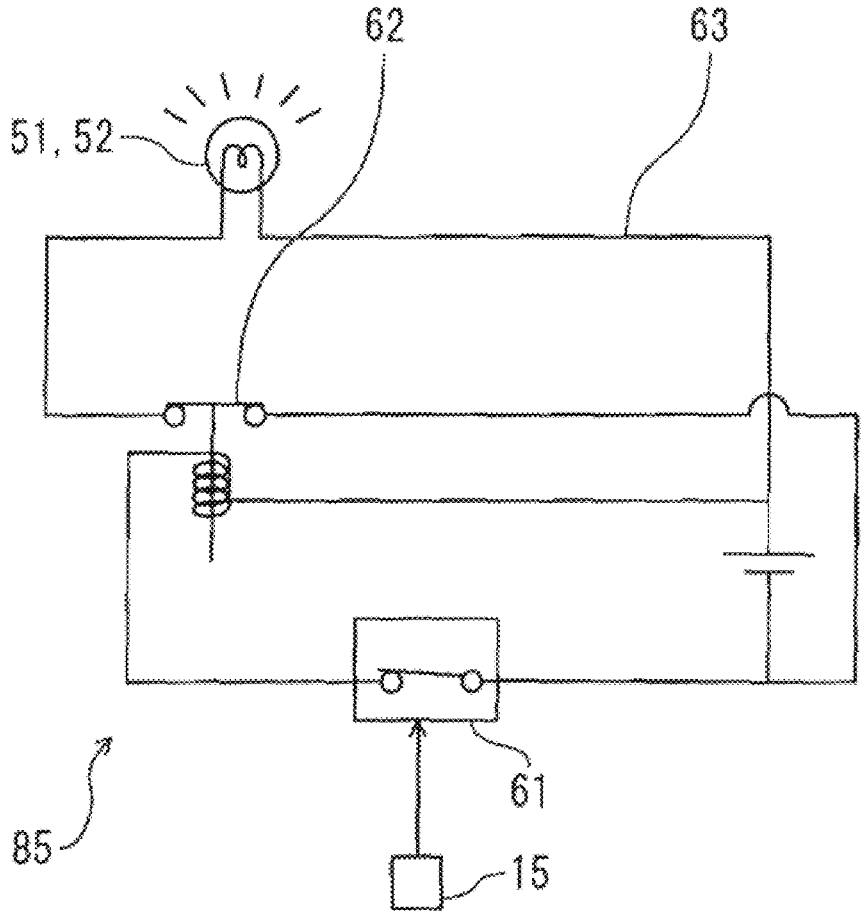

As shown in FIG. 8A and FIG. 8B, the ink jet printer 1 is equipped with a circuit 63 for supplying electric power to the ultraviolet light irradiation devices 51 and 52. Also, the ink jet printer 1 is also equipped with a switch 61 that turns ON and OFF in synch with opening and closing of the front cover 15, and a circuit breaker 62 that disables the supply of electric power to the ultraviolet light irradiation devices 51 and 52.

The switch 61 is a detector that detects the open/close state of the front cover 15, and is attached to the casing 10A or the front cover 15. When the front cover 15 is opened, the switch 61 is placed in an OFF state (FIG. 8A). When the front cover 15 is closed, the switch 61 is placed in an ON state (FIG. 8B).

The circuit breaker 62 is connected when the switch 61 is turned ON. The electric power is supplied to the ultraviolet light irradiation devices 51 and 52 when the circuit breaker 62 is connected. Alternatively, the circuit breaker 62 is disabled when the switch 61 is turned OFF. The electric power is not supplied to the ultraviolet light irradiation devices 51 and 52 when the circuit breaker 62 is disabled.

Accordingly, the ink jet printer 1 is equipped with a stop control device 85 that forcefully stops the irradiation of ultraviolet light by the ultraviolet light irradiation devices 51 and 52 when the front cover 15 is opened. The stop control device 85 processes operations such as detection of the open state of the front cover 15 and preventing irradiation by the ultraviolet light irradiation devices 51 and 52 only via hardware. More specifically, the stop control device 85 functions without any intervening software.

Figure 9:
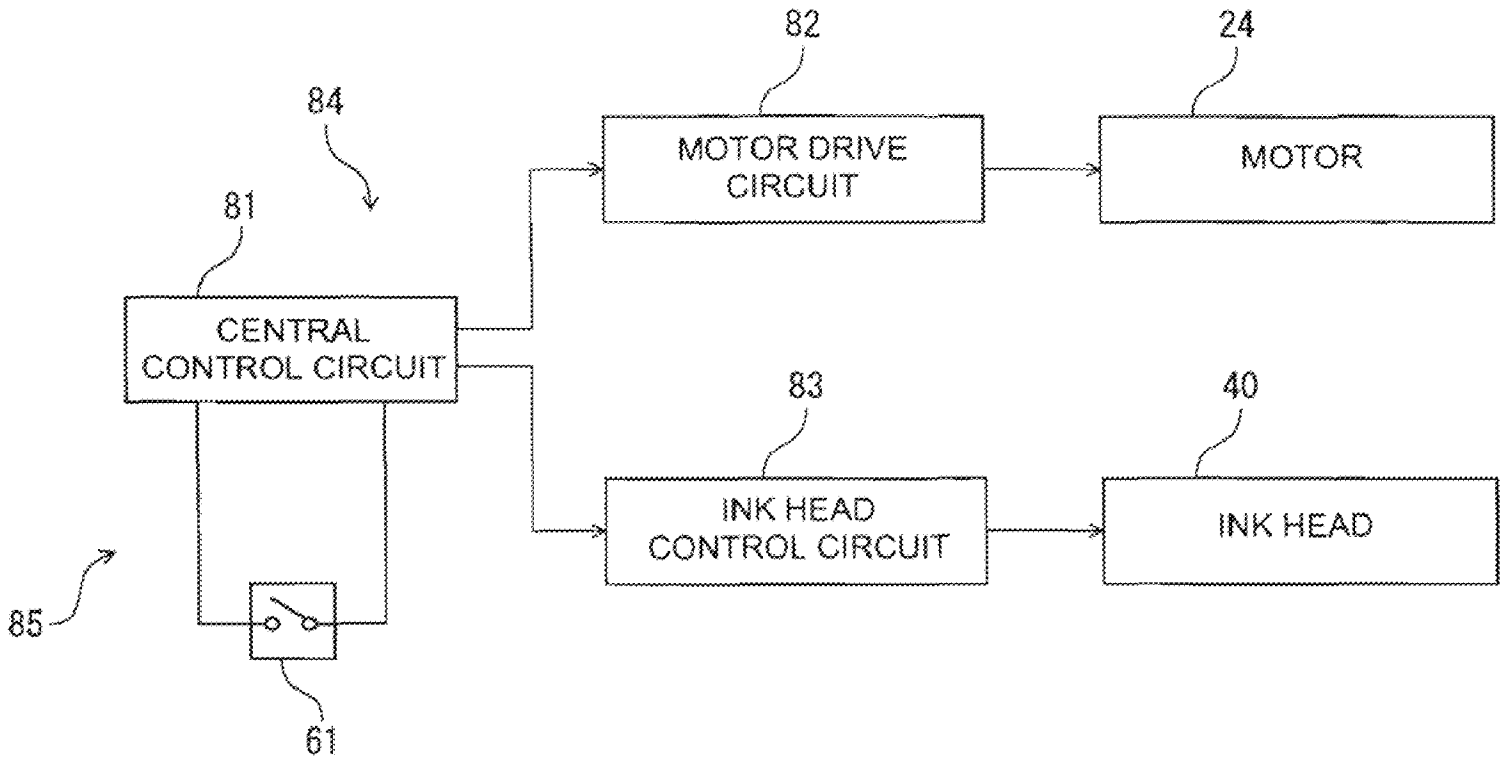
FIG. 9 illustrates the structure of the stop control device illustrated in FIGS. 8A and 8B.

As shown in FIG. 9, the control device 35 of the ink jet printer 1 is equipped with a central control circuit 81, a motor drive circuit 82 that controls a motor 24 in response to a command from the central control circuit 81, and an ink head control circuit 83 that controls the ink head 40 in response to a command from the central control circuit 81.

The central control circuit 81, the motor drive circuit 82, and the ink head control circuit 83 compose a print control device 84 that executes controls for ejection of the ink head 40 and movement of the ink head 40 in the first scanning direction. The central control circuit 81 is connected to the switch 61.

The central control circuit 81 stops ejection of ink by the ink head 40 when the switch 61 is placed in the OFF state. Specifically, the central control circuit 81 stops ejection of ink by the ink head 40 when the front cover 15 is opened. Also, when the switch 61 is placed in the OFF state, the central control circuit 81 moves the ink head 40 from a position where printing stopped toward the home position 200. The central control circuit 81 keeps the ink head 40 in stand by at the home position 200.

The central control circuit 81 receives print data from a computer or terminal, and executes printing according to the print data. The central control circuit 81 is provided with a memory (not shown). When the front cover 15 is opened in the course of printing, the central control circuit 81 has the memory store information regarding the current print data. In other words, the central control circuit 81 has the memory store information corresponding to a portion of the print data where printing has completed, and a portion thereof where printing has not completed.

When the front cover 15 is closed, the switch 61 is set in the ON state. According to the information stored in the memory, the central control circuit 81 may return the state of the ink head 40 to the position at the moment when printing was stopped, and printing may resume.

More specifically, the central control circuit 81 moves the ink head 40 from the home position 200 to the position where printing had stopped. Then, the central control circuit 81 controls the ink head 40 to eject ink and complete the remaining portion of the print operation which. It is noted that the stop control device 85 comprises the print control device 84 and the switch 61.

An operator (not shown) operating the ink jet printer 1 may confirm, at the time of printing, as to whether the recording paper 5 is being properly fed from the roller 45. In this example, the operator would visually inspect the state of the recording paper 5 wound on the roller 5 from the rear of the casing 10A. As the roller 45 is disposed at a relatively low position, the operator would diagonally look down at the roller 45.

As shown in FIG. 5, the ink jet printer 1 is provided with the cover 36 that prevents transmission of ultraviolet light and has at least a portion of the cover 36 positioned above the roller 45. Therefore, ultraviolet light irradiated from the ultraviolet light irradiation devices 51 and 52 can be prevented from striking the operator. Accordingly, the operator would not be exposed to the ultraviolet light even. Therefore, the ink jet printer 1 can reduce harmful exposure of ultraviolet light to the operator.

An operator may lower his viewpoint in order for a detailed observation of the state of the roller 45. For example, the operator may stoop down to visually inspect the state of the roller 45. As shown in FIG. 5, the upper end 36*s* of the cover 36 is positioned higher than the irradiated region 5*a* on the recording paper 5 formed by the ultraviolet light irradiation devices 51 and 52. Therefore, even when the viewpoint of the operator is lowered, ultraviolet light irradiated from the ultraviolet light irradiation devices 51 and 52 can be prevented from striking the operator's eyes.

As shown in FIG. 5, the lower end 36*t* of the cover 36 is positioned above the upper end 45*s* of the roller 45. Additionally, the rear end 36*u* of the cover 36 is positioned towards the rear of the rear end 45*u* of the roller 45.

Since the lower end 36*t* of the cover 36 is positioned above the upper end 45*s* of the roller 45, it would be difficult for the cover 36 to interfere with the work when an operator works on the roller 45 from the rear. Moreover, because the rear end 36*u* of the cover 36 is positioned at the rear end 45*u* of the roller 45, ultraviolet light can be prevented from striking the operator's eyes. Accordingly, improved working conditions and prevention of exposure to ultraviolet light can be achieved.

As shown in FIG. 5, the cover 36 has the sloped segment 36*a* that is sloped downwardly toward the rear. As a result, the size of the cover 36 may be reduced in comparison to a case where the cover is formed by combining a horizontal segment and a vertical segment.

As shown in FIGS. 8A and 8B, the ink jet printer 1 is equipped with the switch 61 that detects the open and close states of the front cover 15. When the switch 61 detects that the front cover 15 is opened while the control device 35 is controlling the ultraviolet light irradiation devices 51 and 52. The stop control device 85 stops irradiation of ultraviolet light by the ultraviolet light irradiation devices 51 and 52. Therefore, the ultraviolet light can be prevented from striking the operator, even when the operator opens the front cover 15 by mistake while ultraviolet light is being irradiated.

The stop control device 85 is equipped with the circuit breaker 62 that is interlocked with ON and OFF actions of the switch 61. In accordance with the ink jet printer 1, the operations of the stop control device 85 are controlled by hardware, and therefore, software-induced errors are reduced or eliminated.

As shown in FIG. 9, the ink jet printer 1 is equipped with the print control device 84 that controls various operations of the ink head 40. When the switch 61 switches from ON to OFF, the stop control device 85 stops the ejection of ink from the ink head 40. Therefore, the ejection of ink by the ink head 40 is terminated when the front cover 15 is opened. Accordingly, wasteful ejection of ink can be prevented. Additionally, imperfect printing can be prevented because the ejected ink would not be improperly irradiated.

When the front cover 15 is opened, the stop control device 85 stops ejection of the ink head 40 and moves the ink head 40 to the home position 200. When the front cover 15 is closed, the ink head 40 is moved from the home position 200 to the position where printing was stopped, and ejection by the ink head 40 is restarted from that position. Therefore, even when the operator opens the front cover 15 by mistake, printing shall be automatically restarted when the front cover 15 is later closed. Accordingly, the ink jet printer 1 may be more user friendly.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed:

1. An ink jet recording apparatus comprising:

a discharge port located on a front side of the ink jet recording apparatus and configured to discharge a recording medium;

a supporting member located on a rear side of the ink jet recording apparatus and configured to support the recording medium;

a roller located below and at a rear side of the supporting member, wherein the recording medium is wound on the roller;

a first transfer mechanism configured to move the recording medium wound on the roller toward the supporting member and through the discharge port;

a guide rail configured to extend in a left-right direction;

an ink head configured to eject ultraviolet light curable ink on the recording medium, the ink head being engaged with the guide rail in a freely moveable manner in the left-right direction and located opposite to the supporting member during a print operation;

a second transfer mechanism configured to move the ink head in the left-right direction;

an ultraviolet light irradiation device that is configured to irradiate ultraviolet light onto the ultraviolet light curable ink ejected on the recording medium, the ultraviolet light irradiation device being coupled to the ink head and positioned opposite to the recording medium during the print operation, wherein the ultraviolet light irradiation device is included in a case of a main body; and a cover that is located at a distal rear side of the ultraviolet light irradiation device, wherein the cover is positioned separate from the ultraviolet light irradiation device at a distal end of the case of the main body, and wherein the cover is further configured to suppress emission of the ultraviolet light, wherein at least a portion of the cover is located above the roller, wherein the discharge port, the supporting member, the guide rail, the ink head, the second transfer mechanism, and the ultraviolet light irradiation device are located inside the case of the main body, and wherein the roller and the cover are located outside of the case of the main body and at a rear side of the case of the main body.

2. The ink jet recording apparatus according to claim 1, wherein an upper end of the cover is positioned above a position where the ultraviolet light is irradiated by the ultraviolet light irradiation device.

3. The ink jet recording apparatus according to claim 1, wherein:

a lower end of the cover is positioned above an upper end of the roller; and a rear end of the roller does not break a vertical plane of a rear end of the cover.

4. The ink jet recording apparatus according to claim 1, wherein the cover comprises a sloped segment that slopes in a downward-diagonal direction.

5. The ink jet recording apparatus according to claim 1, wherein the case comprises an opening that opens at least frontward or upward, and wherein the apparatus further comprises:

a front cover attached to the case and configured to suppress the emission of the ultraviolet light and cover at least a part of the opening such that the front cover can be freely opened and closed;

a detector configured to detect whether the front cover is open or closed;

an irradiation control device configured to control the ultraviolet light irradiation device; and a stop control device configured to terminate the irradiation of ultraviolet light by the ultraviolet light irradiation device when the detector detects that the front cover is open.

6. An ink jet recording apparatus comprising:

a discharge port located on a front side of the ink jet recording apparatus and configured to discharge a recording medium;

a supporting member configured to support the recording medium;

a roller located below and at a rear side of the supporting member, wherein the recording medium is wound on the roller;

a guide rail configured to extend in a left-right direction;

a first transfer mechanism configured to move the recording medium on the supporting member in a front-rear direction;

an ink head configured to eject ultraviolet light curable ink on the recording medium, the ink head being engaged with the guide rail in a freely moveable manner in the left-right direction and disposed opposite to the recording medium during a print operation;

a second transfer mechanism configured to move the ink head in the left-right direction;

an ultraviolet light irradiation device that is configured to irradiate ultraviolet light onto the ultraviolet light curable ink ejected on the recording medium, the ultraviolet light irradiation device being coupled to the ink head in a freely moveable manner and disposed opposite to the recording medium during the print operation, and wherein the ultraviolet light irradiation device is included in a case of a main body, wherein the case is configured to store the supporting member, the ink head and the ultraviolet light irradiation device, wherein the case comprises an opening that opens at least frontward or upward, and wherein the discharge port, the supporting member, the guide rail, the ink head, the second transfer mechanism, and the ultraviolet light irradiation device are located inside the case;

a cover that is attached to the case, located at a distal rear side of the ultraviolet light irradiation device, wherein the cover is positioned separate from the ultraviolet light irradiation device at a distal end of the case of the main body, and wherein the cover is further configured to suppress emission of the ultraviolet light and cover at least a part of the opening such that the cover can be freely opened and closed;

a detector configured to detect whether the cover is open or closed;

an irradiation control device configured to control irradiation of ultraviolet light by the ultraviolet light irradiation device, wherein the irradiation control device is located inside of the case of the main body;

a stop control device configured to prevent the irradiation of ultraviolet light when the detector detects that the cover is open; and a print control device configured to control the second transfer mechanism to move the ink head and control the ink head to eject the ultraviolet light curable ink, wherein the stop control device is further configured to:

control the print control device to stop the ejection of the ultraviolet light curable ink by the ink head and control the print control device to control the second transfer mechanism to move the ink head from a stopped position where the ejection of the ultraviolet light curable ink is stopped to a predetermined home position when the detector detects that the cover is open while the ink head is ejecting the ultraviolet light curable ink; and control the print control device to control the second transfer mechanism to move the ink head from the predetermined home position to the stopped position and control the print control device to control the ink head to resume ejection of the ultraviolet light curable ink in order to restart a printing operation when the detector detects that the cover is closed, wherein the roller and the cover are located outside of the case of the main body and at a rear side of the case of the main body.

7. The ink jet recording apparatus according to claim 6, further comprising a circuit configured to supply electric power to the ultraviolet light irradiation device, wherein:

the detector comprises a switch attached to the case or the cover, the switch turning ON in response to opening the cover and turning OFF in response to closing the opened cover; and the stop control device comprises a circuit breaker provided in the circuit and configured to be placed in a shutoff state in response to the switch turning ON.

* * * * *